US011391092B2

(12) United States Patent
Jostes et al.

(10) Patent No.: US 11,391,092 B2
(45) Date of Patent: Jul. 19, 2022

(54) GROUND DRILLING DEVICE, SYSTEM COMPRISING THE GROUND DRILLING DEVICE, METHOD FOR PRODUCING A GROUND DRILLING DEVICE, AND USE OF A GROUND DRILLING DEVICE

(71) Applicant: TRACTO-TECHNIK GmbH & Co. KG, Lennestadt (DE)

(72) Inventors: Lucas Jostes, Finnentrop (DE); Stefan Hermes, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 16/786,290

(22) Filed: Feb. 10, 2020

(65) Prior Publication Data

US 2020/0300041 A1 Sep. 24, 2020

(30) Foreign Application Priority Data

Feb. 20, 2019 (DE) ..... 10 2019 001 201.1

(51) Int. Cl.

| | |
|---|---|
| ***E21B 3/02*** | (2006.01) |
| ***E21B 4/00*** | (2006.01) |
| ***E21B 7/00*** | (2006.01) |
| ***E21B 7/20*** | (2006.01) |
| ***E21B 7/02*** | (2006.01) |

(52) U.S. Cl.

CPC ..... *E21B 3/02* (2013.01); *E21B 3/022* (2020.05); *E21B 4/006* (2013.01); *E21B 7/002* (2013.01); *E21B 7/02* (2013.01); *E21B 7/20* (2013.01)

(58) Field of Classification Search

CPC ... E21B 3/02; E21B 7/002; E21B 7/02; E21B 7/022; E21B 7/025; E21B 7/04; E21B 7/046

See application file for complete search history.

(56) References Cited

U.S. PATENT DOCUMENTS

| | | | | |
|---|---|---|---|---|
| 2011/0114391 | A1 | 5/2011 | Scheider | |
| 2013/0068490 | A1* | 3/2013 | Van Zee | E21B 7/04 173/1 |
| 2014/0284111 | A1* | 9/2014 | Van Zee | E21B 3/02 175/122 |

FOREIGN PATENT DOCUMENTS

| | | | |
|---|---|---|---|
| CH | 704 416 | A2 | 7/2012 |
| DE | 197 04 263 | C1 | 8/1998 |
| DE | 197 21 059 | C1 | 11/1998 |
| DE | 10 2006 059 171 | B3 | 4/2008 |
| DE | 10 2008 021 491 | A1 | 11/2009 |
| DE | 20 2010 014 478 | U1 | 12/2010 |
| DE | 10 2010 010 036 | A1 | 9/2011 |
| DE | 10 2011 122 143 | A1 | 6/2013 |
| EP | 2 093 373 | A1 | 8/2009 |

* cited by examiner

*Primary Examiner* — Tara Schimpf

(74) *Attorney, Agent, or Firm* — Howard IP Law Group, PC

(57) ABSTRACT

A ground drilling device with a drivetrain for rotating a drill string, wherein at least one section of the drivetrain is configured to form a channel between a force transmission element of the drivetrain and the drill string, wherein the channel projects through the force transmission element and the force transmission element may be driven radially in the drivetrain.

17 Claims, 1 Drawing Sheet

GROUND DRILLING DEVICE, SYSTEM COMPRISING THE GROUND DRILLING DEVICE, METHOD FOR PRODUCING A GROUND DRILLING DEVICE, AND USE OF A GROUND DRILLING DEVICE

FIELD OF INVENTION

The invention relates to a ground drilling device, a system comprising the ground drilling device, a method for producing a ground drilling device, and a use of a ground drilling device.

BACKGROUND

In order to be able to introduce a borehole into the ground, a drill string having rod sections is usually used, which is connected to a drive in order to be able to move the drill string translationally, pushing or pulling, and/or rotating about its longitudinal axis. For this purpose, a drive is used that is usually axially connected to the drill string. This type of drive is known and its handling has proven itself; however the complexity of the design of a ground drilling device may increase if flushing liquid is to be fed through the interior of the drill string axis in order to support the introduction of the borehole and/or a double drill string, which has an inner drill string and an outer drill string, is used for introducing the borehole.

SUMMARY

The underlying object of the invention is to provide a ground drilling device, a system comprising the ground drilling device, a method for producing a ground drilling device, and a use for a ground drilling device, in which a simpler design of the ground drilling device is possible and/or a more flexible design of the ground drilling device to different requirements is possible.

The core concept of the invention is to easily form a channel to the drill string or to easily form a channel that can be easily accessed, by means of which a supply of flushing liquid into the drill string, a feeding of a cable into the drill string for cable-guided drilling, and/or an application of force by means of another drivetrain is enabled. A force transmission element is used for this purpose, which is part of the drivetrain and through which the channel is at least partially formed, i.e., the channel penetrates through the force transmission element. In order that the channel, which extends through the force transmission element, is not interrupted or does not have any excessively large obstacles, the force transmission element is radially driven in the drivetrain. The radial drive of the force transmission element enables the use of a force engaging radially from outside to move the force transmission element. An axial access or through passage is possible on at least one section of the channel, which extends through the force transmission element, or the section of the channel, which penetrates through the force transmission element. This type of axial access simplifies the design of the ground drilling device. In spite of the engagement of the force transmission means, the interior of a rod section or the interior of the drill string may still be axially accessed, thus, space or room may remain for a flexible connection with flushing liquid and/or another drive for an, in particular additional, in particular internal, drill string.

The invention creates a ground drilling device with a drivetrain for rotating a drill string. At least one section of the drivetrain is configured for forming a channel between a force transmission element of the drivetrain and the drill string. The channel penetrates through the force transmission element and the force transmission element is radially drivable in the drivetrain.

In the meaning of the invention, a "ground drilling device" is any device which moves, in particular a drill string having rod sections in an existing channel or channel to be established in the ground, in order to generate or enlarge a borehole, in particular a horizontal borehole (HD), or to insert pipelines or other long bodies into the ground. The ground drilling device may, in particular, be an HD device, wherein the borehole or the channel or the pipeline may be arranged at least partially horizontally. A ground drilling device may thus be a device driving a drill string, which may function in a soil displacing way, and introduces the drill string translationally and/or rotationally into the ground in the longitudinal axial direction of the drill string. A borehole may be introduced into the ground by applying traction or compression on the drill string.

In the meaning of the invention, the term "rod section" thereby does not exclusively comprise rigid, individual force transmission elements, which are directly or indirectly connectable and may be used in a ground drilling device. A rod section may, in particular, be a section of a simple rod or a section of a double drill string with an outer drill string and an inner drill string. A front side section of the drill string, which may arrive as first to contact the ground, may be equipped as a drill head or as a drilling tool. Furthermore, the drill string may have a probe housing, in particular in a front side area.

A "drivetrain" comprises, in the meaning of the description, elements or components, which are present for rotating the drill string in the ground. The elements or components may, in particular, be elements or components that generate the power for the drive to rotate, and transfer the power up to the drill string or to the end of the drill string spaced apart from the drill head, i.e., to the end which projects out of the ground. The drivetrain may thus have a drive in the form of a motor; the motor may form a "start" of the drivetrain. In particular, the drivetrain may have a component or an element for the transition to the drill string or to the last rod section of the drill string (the "end" of the drivetrain) which is spaced apart from the front side section of the drill string, and the component or element may form a form-fitting connection to the drill string or to the last rod section of the drill string. The component or the element may be designated as an adapter and may be axially connected, in particular directly, to the force transmission element. It may also be provided that no other element is present between the force transmission element and the drill string or that another element is present between the force transmission element and the drill string. Another element, in particular in the form of an adapter, enables on the one hand an exchange caused by wear, which may be more easily carried out than an exchange of the force transmission element, and on the other hand a more flexible planning or production of a ground drilling device. The drivetrain may be configured identically up to the adapter for different strings; only the adapter requires an adaptation to the force transmission element.

The term "channel" comprises, in the meaning of the description, a through passage, in particular closed on the circumferential side, wherein the circumference of the through passage may vary along its longitudinal extent. The variation may relate to the size and shape of the circumference. The through passage may be shaped as round, as an ellipse, or polygonal. In one particularly preferred embodiment, the through passage is configured as round in diameter, in particular as circular. The term "channel" comprises, in the meaning of the description, in particular a through passage, whose cross section or circumference may not be substantially smaller than the cross section of the interior of the rod section, which is connected to the force transmission element, across the length through the force transmission element up to the last rod section of the drill string cross section. The channel has, in particular, an inner contour, which may change in the length of the channel, and offers an outer delimitation of the channel, in which other elements and/or flushing liquid may be guided. The term channel does not exclude that additional channels may be formed in the channel. For example, an "inner" channel may be formed in an "outer" channel, which inner channel has, for its part, an inner contour which is a delimitation of the "inner" channel.

The term "force transmission element" comprises, in the meaning of the description, an element, with which a force, in particular a rotational force or a force for turning, is transmitted. In particular, the force transmission element may be rotated and the applied force is propagated in the direction, in which the force was applied from outside onto the force transmission element. The force transmission element may be connected at least indirectly to the drill string in the longitudinal direction. The force transmission element may be connected on an end side to the adapter and/or drill string for force transmission.

If the channel is designed to penetrate through the force transmission element, then it is understood that the channel extends through the force transmission element or is formed at least partially in the force transmission element. The force transmission element at least partially forms a section of the channel.

In one preferred embodiment, an additional drivetrain is provided. One section of the additional drivetrain is configured to form an additional channel between an additional force transmission element of the additional drivetrain and the drill string. The additional channel penetrates through the additional force transmission element, and the additional force transmission element is radially drivable in the additional drivetrain. By this means, an additional access or feeding is carried out.

The force transmission element may be penetrated at least partially be the additional drivetrain. The additional force transmission element—likewise the force transmission element—may be penetrated by a channel for flushing liquid.

In one particularly preferred embodiment, the additional channel penetrates the channel or is connected to the same. In one particularly preferred embodiment, the force transmission element and the additional force transmission element may be aligned coaxially to one another.

In one preferred embodiment, the force transmission element and/or—if an additional force transmission element is present—the additional force transmission element is/are hollow shaft(s). Due to the configuration as a hollow shaft, an axial access is possible and, in the case of a hollow shaft, an expansion of the inventive concept radially outward results for the selected type of drive. The inventors have thereby recognized that the use of a hollow shaft is possible for transmitting high forces, despite the initial contrary physical consideration. The inventors confronted the initially irrational approach of being able to use a hollow shaft.

In one preferred embodiment, a drive for driving the force transmission element and/or—if an additional drivetrain is present—the additional drive is/are configured as hollow shaft motor(s). A drive may be considered in particular to be a hollow shaft motor, by means of which the force transmission element or the additional force transmission element, which may be configured, in particular, as hollow shafts, are accessible from outside via a toothing. Additionally or alternatively, another form-fitting or force-fitting connection or linkage is possible, in addition to or instead of the toothing, for example, in the form of a polygon profile or a feather key connection.

By means of a hollow shaft motor configured in the meaning of the description, it is possible to omit a spur gear transmission, which extends laterally to the hollow shaft or to another drive element. The hollow shaft motor may function according to a spindle-(spindle)-nut principle. It may be provided that an element arranged around the hollow shaft is driven by a motor and thus moves the hollow shaft. The element may be a/n (additional) hollow drive shaft, for example, with an inner toothing, which,—if an inner toothing is present—meshes or engages with or on an outer toothing on the hollow shaft to be driven. An element of the hollow shaft motor, itself configured as a hollow shaft, driving the hollow shaft, may extend around the hollow shaft so that the driving element surrounds the hollow shaft. It may be designed as a splined shaft/splined hub connection. In particular, the driving element may not be mounted laterally next to the hollow shaft. The unit of the hollow shaft motor may compactly lie around the hollow shaft and may have substantially identical dimensions in the spatial direction, without a substantial extension being present in only one spatial direction—for example, in the case of a spur gear transmission.

In one preferred embodiment, the hollow shaft motor is designed as a hydraulic motor in order to be able to apply high torques for the rotational movement. Furthermore, hydraulic motors are known in the area of ground drilling devices and are easy to handle.

In one preferred embodiment, an adapter is provided, which is connected on one end to the force transmission element and is configured on its other end in order to be connected to the last rod section of the drill string. The adapter also forms a section of the channel. Adapters enable a flexible adaptation to different rod sections or types of rod section.

The invention also creates a system comprising a described ground drilling device and at least one rod section. The rod section is adapted, in particular, to the force transmission element and/or to an optionally available adapter of the ground drilling device.

An "adapter" comprises, in the meaning of the description, an element, which may be adapted on one side to the connection at a rod section of the drill string. The other end may be adapted to a connection to the force transmission element. The adapter provides the possibility of a connection to a rod section, so that the adapter may also be designated as a "connection". In this respect, the terms "connection" and "adapter" may be used and understood synonymously. To form a section of the channel or for the purposes of "not blocking" the channel, the adapter, for its part, has a channel, which may extend, in particular, in the longitudinal direction of the adapter. The channel or the through passage may have, in particular, a diameter which substantially corresponds to the diameter of the force transmission element. An adapter may be connected to a force transmission element. However, it is also possible that an adapter is connected indirectly to a force transmission element, for example, in order to bridge a larger length or spatial extension. This may be the case, in particular if an additional drivetrain is provided, which, for its part, penetrates through the force transmission element of the "first" drivetrain, in order to extend through the channel of the "first" force transmission element.

In one preferred embodiment, the rod section is configured as a double drill string section.

The invention also creates a method for producing a ground drilling device with a drivetrain for rotating a drill string. The ground drilling device may be a described ground drilling device or it may be another type of ground drilling device. The method comprises the steps: provision of a drivetrain, forming a channel between a force transmission element of the drive and a connection for the drill string, wherein the channel is formed through the force transmission element. Furthermore, the method has the step that a radial force application is provided for the force transmission element.

The invention also creates a use of a ground drilling device for ground drilling. The ground drilling device has a drivetrain for rotating a drill string. At least one section of the drivetrain is used to form a channel between a force transmission element of the drivetrain and the drill string. The force transmission element is penetrated to form the channel and a radial force application is used for the drive of the force transmission element.

The invention is described by means of the aspects ground drilling device, system comprising the ground drilling device, method for producing a ground drilling device, and use of a ground drilling device. The comments regarding the individual aspects supplement one another, so that the comments with respect to the ground drilling device also apply for the other aspects relating to a system, a method, and a use. Feature and embodiments described with respect to one aspect are also disclosed for the other aspects in an analogous way.

The preceding comments and likewise the subsequent description of exemplary embodiments do not present an elimination of certain embodiments or features.

BRIEF DESCRIPTION OF THE DRAWINGS

The invention is subsequently described in greater detail with reference to an embodiment depicted in the figures.

As shown in.

DETAILED DESCRIPTION

Figure 1:
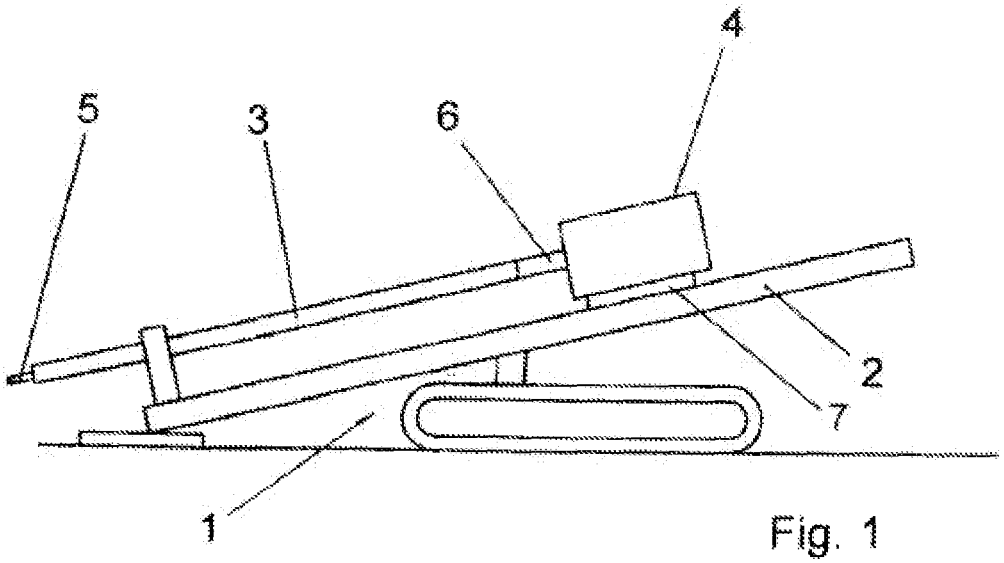
FIG. 1 is a schematic depiction of a ground drilling device from the side with a double drill string section connected to the ground drilling device.

FIG. 1 schematically shows a ground drilling device 1. Ground drilling device 1 has a drivable drilling carriage 2, which functions as a guide for drive 4. Using drive 4, a drill string, which has rod sections, may be moved through the ground translationally i.e., pushing or pulling by means of drive 4 on drilling carriage 2. Drive 4 is also configured for a rotational drive of the drill string.

Thrust or traction forces may be applied via string adapter 6 to a double drill string, which has a rod section, as is schematically depicted in FIG. 1. The rod section, which has an inner drill string 5 and an outer drill string 3, to which torques and/or rotational speeds for inner drill string 5 and outer drill string 3 may respectively be applied, independently from one another via string adapter 6.

Figure 2:
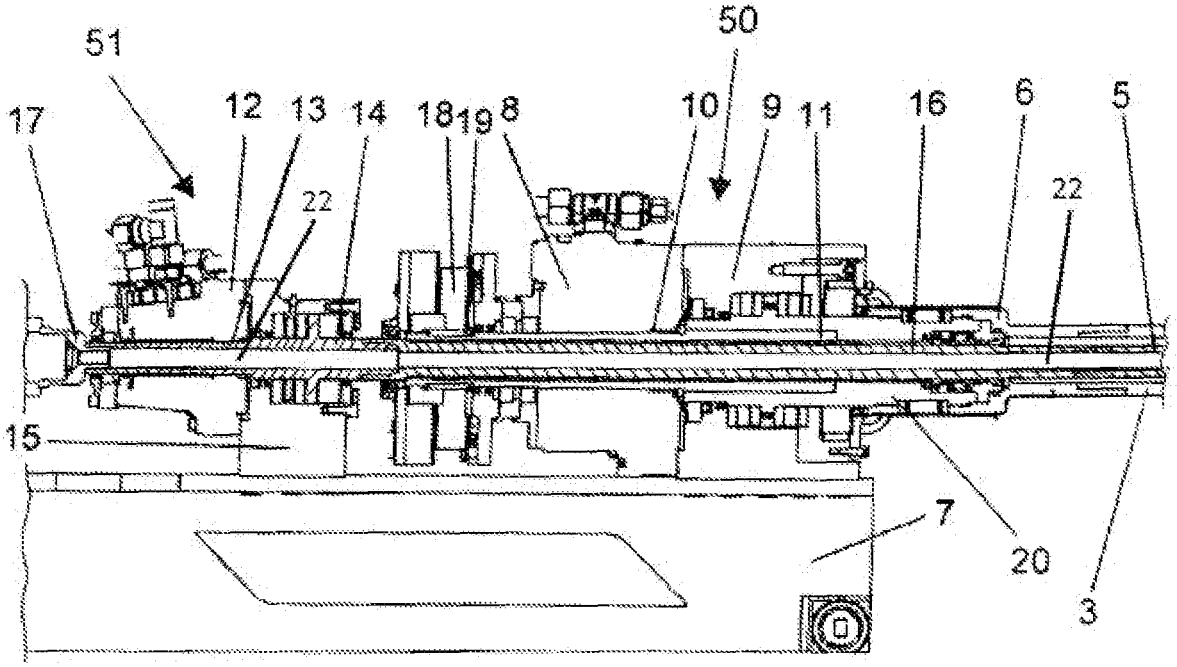
FIG. 2 is a sectional depiction of an area of a drive train of the ground drilling device shown in FIG. 1.

FIG. 2 shows in more detail two drivetrains 50, 51 of ground drilling device 1, shown in FIG. 1, with the end of the double drill string section also depicted in FIG. 1. FIG. 2 further shows the housing frame 7, translationally guided on drilling carriage 2, by means of which the translational movements are possible with respect to the drilling carriage 2 in the direction of the drill string axis. Housing frame 7 is suited for supporting elements of drivetrains 50, 51. Drivetrain 50 has a drive configured as hydraulic motor 8 and a bearing housing 9. Hydraulic motor 8 is flange mounted on bearing housing 9. Hydraulic motor 8 is designed as a hollow shaft motor, which engages via a toothing 10 on a force transmission element 11 configured as a hollow shaft. Force transmission element 11 is connected to an adapter 20. Adapter 20 is mounted on force transmission element 11. Adapter 20 is connected to outer drill string 3 via string adapter 6 in order to transfer the torque and the rotational movement to outer drill string 3.

A channel 22 is formed through force transmission element 11 and through adapter 20 connected to force transmission element 11, in the interior of which channel 22 a supply may be established to the drill string. The supply is used both for a drive of inner drill string 5 and also for the supply of flushing liquid, which will be subsequently described in greater detail.

For the drive of inner drill string 5, a second hollow shaft motor 12 is provided as the drive, which is flange mounted on a second bearing housing 15. Second hollow shaft motor 12 engages from radially outside via a second toothing 13 on an additional force transmission element 14, which is configured as a hollow shaft. Second force transmission element 14 is connected to an adapter 16 configured as an inner adapter. Adapter 16 is for its part connected at the other end to inner drill string 5 in order to transfer torque and rotational movement to inner drill string 5 by means of second drivetrain 51, independently from the drive of outer drill string 3.

Furthermore, a rotary feed through 17 is depicted in FIG. 2 which is attached in a centered way on additional force transmission element 14 on the side spaced apart from adapter 16 for feeding flushing liquid.

For directional control of the drill string, an asymmetrical drill head may be used, which may be rotated into the drilling direction to be controlled via outer drill string 3. In the control position, it is necessary to secure force transmission element 11 with connected outer drill string 3 and the drilling head against rotating. This is carried out in the embodiment depicted in FIG. 2 by means of a stop brake 18, which is connected to force transmission element 11 via a feather key 19.

The invention claimed is:

1. A ground drilling device with a drivetrain for rotating a drill string, wherein at least one section of the drivetrain is configured to form a channel that extends through a force transmission element of the drivetrain to the drill string, wherein the force transmission element is radially drivable in the drivetrain by a drive of the drivetrain, the drive comprising a hollow shaft motor having a driving element that surrounds the force transmission element, the drive being without gearing that extends lateral to the drill string for moving the driving element.

2. The ground drilling device according to claim 1, further comprising an additional drivetrain, wherein a section of the additional drivetrain is configured to form an additional channel that extends through an additional force transmission element of the additional drivetrain to the drill string, and the additional force transmission element is radially drivable in the additional drivetrain by an additional drive comprising an additional hollow shaft motor.

3. The ground drilling device of claim 2, wherein the force transmission element and the additional force transmission element each comprise a hollow shaft.

4. The ground drilling device of claim 2, wherein the hollow shaft motor and the additional hollow shaft motor each comprise a hydraulic motor.

5. The ground drilling device of claim 2, wherein the drill string includes a plurality of rod sections, and further comprising an adapter through which the channel extends which is connected at one end to the force transmission element and which is configured at its other end to be connected to a last rod section.

6. The ground drilling device of claim 2, further comprising a rotary feedthrough attached to the additional force transmission element and configured for feeding flushing liquid to the drill string.

7. The ground drilling device according to claim 1, wherein the force transmission element is a hollow shaft.

8. The ground drilling device according to claim 1, wherein the hollow shaft motor is configured as a hydraulic motor.

9. The ground drilling device according to claim 1, wherein the drill string comprises a plurality of rod sections, and further comprising an adapter connected at one end to the force transmission element and configured at its other end in order to be connected to a last rod section of the drill string, wherein the adapter forms a section of the channel.

10. A system comprising: a ground drilling device having a drill string, a drivetrain for rotating the drill string, wherein at least one section of the drivetrain is configured to form a channel that extends through a force transmission element of the drivetrain to the drill string, wherein the force transmission element is radially drivable in the drivetrain by a drive of the drivetrain comprising a hollow shaft motor having a driving element that surrounds the force transmission element, the drive being without gearing that extends lateral to the drill string for moving the driving element, wherein the drill string includes at least one rod section.

11. The system according to claim 10, wherein the at least one rod section is configured as a double drill string rod section.

12. The system according to claim 10, further comprising an additional drivetrain, wherein a section of the additional drivetrain is configured to form an additional channel that extends through an additional force transmission element of the additional drivetrain to the drill string, and the additional force transmission element is radially drivable in the additional drivetrain by an additional drive comprising an additional hollow shaft motor.

13. The system of claim 12, further comprising a rotary feedthrough attached to the additional force transmission element and configured for feeding flushing liquid to the drill string.

14. A method for producing a ground drilling device with a drivetrain for rotating a drill string, comprising: forming a channel that extends through a force transmission element of the drivetrain and through a connection for the drill string to the drill string; and providing, by a hollow shaft motor drive of the drivetrain having a driving element that surrounds the force transmission element without gearing that extends lateral to the drill string for moving the driving element, a radial force application to drive the force transmission element to rotate the drill string.

15. The method of claim 14, wherein the step of forming the channel that extends through the force transmission element of the drivetrain and the connection for the drill string further comprises mounting on the force transmission element an adaptor connection through which the channel extends and which connects to an outer section of the drill string to transfer the torque and the rotational movement thereto.

16. The method of claim 14, wherein forming the channel further comprises forming a channel that extends through an additional force transmission element of an additional drivetrain; and further comprising providing an additional hollow shaft motor drive of the additional drivetrain configured to apply a radial force to drive the additional force transmission element to rotate the drill string.

17. The method of claim 16, further comprising attaching a rotary feedthrough to the additional force transmission element for feeding flushing liquid to the drill string.

* * * * *